US007422773B2

(12) United States Patent
D'Andreta

(10) Patent No.: US 7,422,773 B2
(45) Date of Patent: Sep. 9, 2008

(54) METHOD AND APPARATUS FOR CREATING AN ENHANCED ELECTRICAL FIELD TO IMPROVE PAINT TRANSFER EFFICIENCIES

(75) Inventor: Mark D'Andreta, Brandon Township, MI (US)

(73) Assignee: TD Industrial Coverings, Inc., Sterling Heights, MI (US)

( * ) Notice: Subject to any disclaimer, the term of this patent is extended or adjusted under 35 U.S.C. 154(b) by 482 days.

(21) Appl. No.: 11/116,050

(22) Filed: Apr. 27, 2005

(65) Prior Publication Data

US 2006/0124769 A1 Jun. 15, 2006

Related U.S. Application Data

(60) Provisional application No. 60/634,828, filed on Dec. 9, 2004.

(51) Int. Cl.

| | |
|---|---|
| ***B05B 1/28*** | (2006.01) |
| ***B05B 3/00*** | (2006.01) |
| ***B05B 5/025*** | (2006.01) |
| ***B05D 1/02*** | (2006.01) |

(52) U.S. Cl. ..... 427/483; 118/326; 118/629; 118/323; 427/427.2; 901/49; 74/490.02

(58) Field of Classification Search ..... 118/323, 118/326, 300, 620, 621, 623, 629; 427/475, 427/458, 483, 421.1, 427.1, 427.2, 427.3; 239/690, 691, 104–105; 428/99, 57, 58; 74/490.01, 490.02, 490.03; 901/41, 43, 49; 399/135; 150/154, 165

See application file for complete search history.

(56) References Cited

U.S. PATENT DOCUMENTS

| | | | | |
|---|---|---|---|---|
| 4,624,043 | A * | 11/1986 | Bennett | 483/55 |
| 4,824,026 | A * | 4/1989 | Tamura et al. | 239/707 |
| 4,904,514 | A | 2/1990 | Morrison et al. | 428/53 |
| 6,082,290 | A | 7/2000 | Conlin | 118/326 |
| 6,543,307 | B2 * | 4/2003 | Ambrose | 74/490.03 |

FOREIGN PATENT DOCUMENTS

| | | |
|---|---|---|
| JP | 08-164349 | 6/1996 |
| JP | 09-262510 | 10/1997 |
| JP | 09-267057 | 10/1997 |

* cited by examiner

*Primary Examiner*—Yewebdar T Tadesse
(74) *Attorney, Agent, or Firm*—Harness, Dickey & Pierce, P.L.C.

(57) ABSTRACT

A cover for a robot which includes an electrostatic spray gun with a nozzle which sprays charged material. The cover includes an insulating layer adapted to generally surround the robot except at an aperture where the nozzle extends from the cover. The cover also includes a conductor on the insulating layer near the aperture and spaced apart from the robot. A charge source provides an electric charge to the conductor.

21 Claims, 4 Drawing Sheets

METHOD AND APPARATUS FOR CREATING AN ENHANCED ELECTRICAL FIELD TO IMPROVE PAINT TRANSFER EFFICIENCIES

CROSS-REFERENCE TO RELATED APPLICATIONS

This application claims the benefit of U.S. Provisional Application No. 60/634,828 filed on Dec. 9, 2004. This related application is hereby incorporated by reference as if fully set forth herein.

FIELD OF THE INVENTION

The present invention relates to industrial robot covers, and more particularly to a painting robot cover.

BACKGROUND OF THE INVENTION

Few industrial applications demand as stringently clean a working environment as paint facilities. Even the most advanced robotic paint systems are subject to contamination, and even the smallest contaminant can ruin an otherwise perfect finish. Thus, the painting equipment must be kept clean and must be isolated from the painted surfaces so that contaminates from the equipment may not migrate from the equipment to the painted surface.

Typically, in high volume, high value manufacturing facilities, robotic painters are employed along with electrostatic spray guns. The robotic painters allow for automating the painting process. Yet, the robots tend to generate particles as the arms of the robot move. Moreover, lubricants and other working fluids (e.g. compressed air or hydraulic fluid) may escape in minute amounts. Even these minute amounts of contaminants may disadvantageously impact the quality of the finished surface.

Additionally, the electrostatic spray guns employed also contribute to the contamination level. Material sprayed from the gun may entrain contaminates from the robot and carry them to the painted surface. Furthermore, the differential charge applied between the gun and the painted surface, which attracts the paint to the surface, also attracts charged particles from the gun and the robot. Thus, painting robots, as well as other types of painting equipment, act as a source of disadvantageous contamination.

One solution to the painting equipment itself being a source of contaminates, and to keeping the equipment clean, has been to apply a cover over the equipment to prevent migration of contaminates to the painted surface. These covers typically include an opening for the nozzle to extend from the cover yet otherwise surround the robot. Thus, the cover traps the vast majority of contamination from the robot. These covers have been well received by the industries in which consumers demand high quality finished surfaces. In particular, TD Industrial Coverings of Sterling Heights, Mich. has supplied the automotive industry numerous high quality industrial covers.

As previously mentioned electrostatic spray guns use electrostatic attraction to assist in painting the surface. Such an approach improves the transfer efficiency of the spray gun by ensuring that more of the paint reaches and sticks to the surface to be painted. Moreover, by improving the efficiency of the electrostatic spraying devices, fewer paint fumes escape the manufacturing facility than with conventional (non electrostatic) spray guns.

Despite the use of electrostatic spray guns, paint particles may still escape deposition on the object for a variety of reasons. For instance, the object to be painted may include geometry which makes the object difficult to paint, thereby requiring more paint to be applied than would otherwise be the case. Examples of difficult geometry include narrow grooves and other recesses with sharp aspect ratios. Difficulties in atomizing the paint may cause larger than optimal drops to form which gravity causes to fall from the spray. Variations in the compressed air supply pressure may deviate from the optimal range. Likewise, electromagnetic fields from nearby devices may alter the path of the paint particles. Or drafts in the painting area, or booth, may cause the spray pattern to drift from the object.

To use these electrostatic spray guns the object to be painted is initially charged with one polarity of electrical charge. The paint is charged with the opposite polarity. As the paint discharges from the gun, the charge on the object attracts the oppositely charged paint droplets. Accordingly, the paint preferentially travels toward the object whereas conventional spray guns produce a cloud of paint particles which are more likely to partially disperse on their way to the object.

Even electrostatic spray guns however suffer from disadvantages. For instance, some of the paint particles will drift from the spray pattern even if charged. Thus, a need exists to improve the efficiency of electrostatic spray guns still further. Additionally, as the charged paint particles encounter the oppositely charged object the energy used to charge the paint particles and the object is used. The flow of charge (on the paint particles) therefore represents a power consuming electrical current that must be continuously re-supplied. Accordingly, an electrostatic spray gun requires power from an electric utility or cogeneration unit. Thus, a need exists to lower the power requirement of existing electrostatic spray guns.

SUMMARY OF THE INVENTION

The present invention is directed to a cover for a material spraying robot. More particularly, the present invention is directed toward a cover which includes a conductor to enhance the electric field generated by an electrostatic spray gun held by the robot. In one particular application, the cover of the present invention includes a conductor which covers the top, front surface of the cover near the nozzle of the spray gun.

The present invention also provides a method of painting an object using the cover. In the method a conductive material is used to enhance an electric field of an electrostatic spray gun. Doing so increases the transfer efficiency of the spray gun and reduces overspray. The spray gun is included in a robot which is generally surrounded by a cover with an aperture. A nozzle of the spray gun extends from the aperture and sprays electrically charged material onto an object. The conductor is placed on the surface of the cover near the aperture and charged to enhance the electric field.

In a second embodiment, a cover is provided for a robot which includes an electrostatic spray gun with a nozzle which sprays charged material. The cover includes an insulating layer adapted to generally, or at least partially, surround the robot except at an aperture where the nozzle extends from the cover. The cover also includes a conductor on the insulating layer near the aperture and spaced apart from the robot. A charge source provides an electric charge to the conductor.

In a third embodiment, an industrial material spraying robot is provided. The robot includes a spray gun with a nozzle which sprays electrically charged material. An insulating cover at least partially surrounds the robot and includes an aperture which allows the nozzle to extend from the aperture. A conductor is on the cover and is spaced apart from the robot. An electric charge source coupled to the conductor charges the conductor with a charge opposite that of the material to be sprayed.

Further areas of applicability of the present invention will become apparent from the detailed description provided hereinafter. It should be understood that the detailed description and specific examples, while indicating the embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DESCRIPTION OF THE EMBODIMENTS

Figure 1:
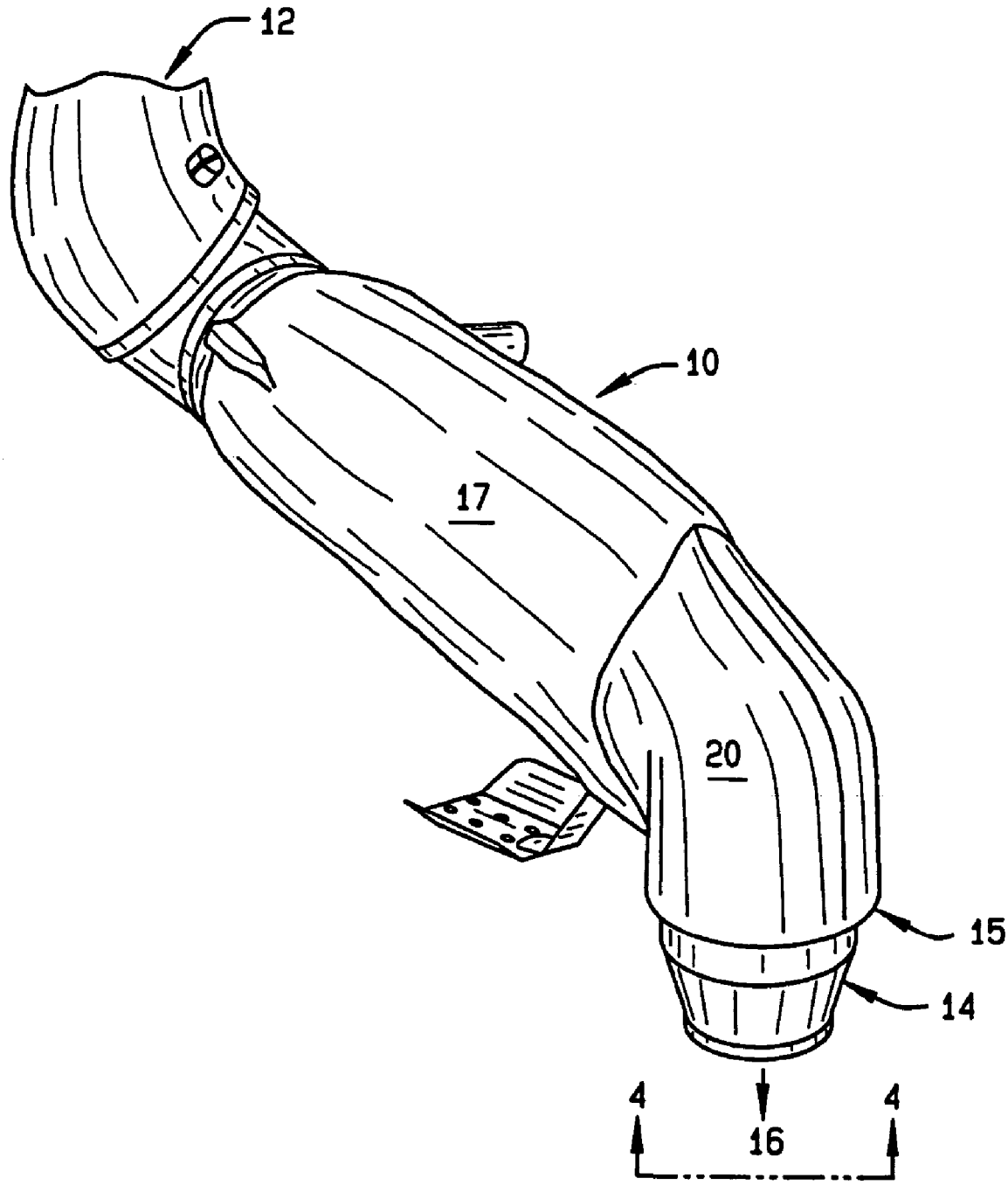
FIG. 1 is a perspective view of a cover assembly in accordance with a first embodiment of the present invention.
Figure 2:
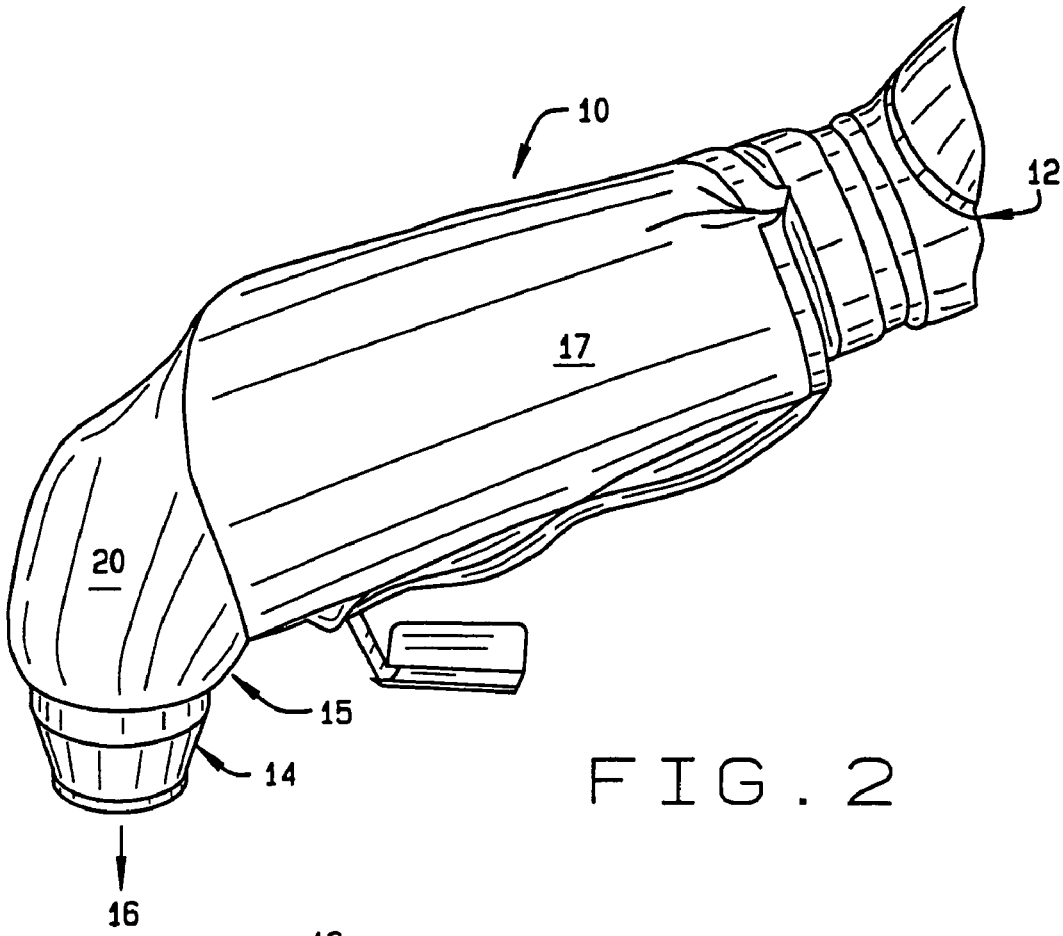
FIG. 2 is a side view of the cover of FIG. 1.
Figure 3:
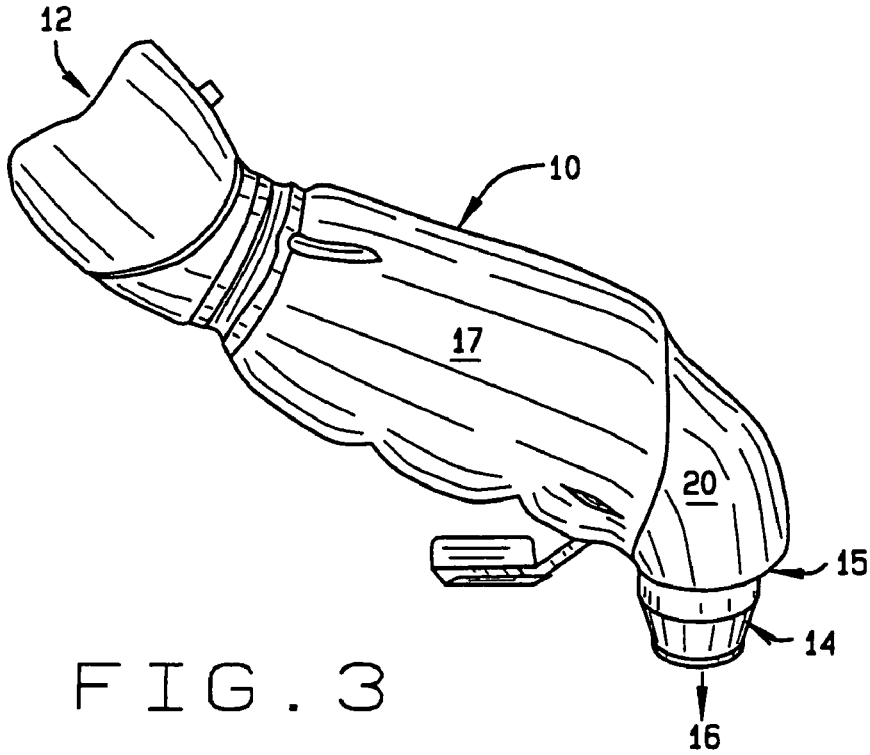
FIG. 3 is another side view of the cover assembly of FIG. 1.
Figure 4:
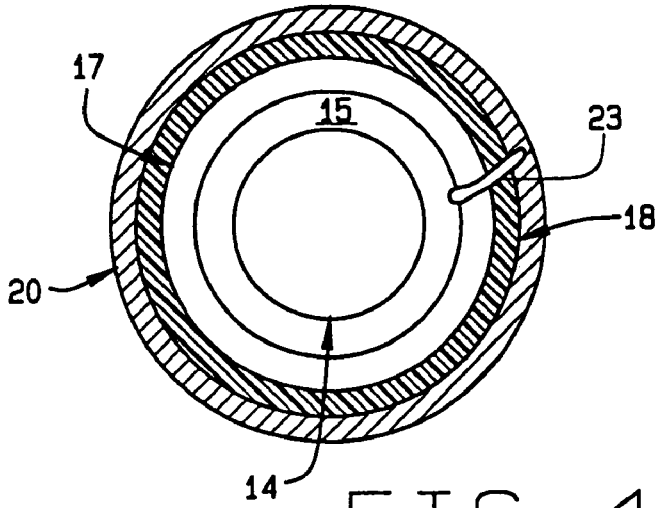
FIG. 4 is an end view taken in the direction of the line 4-4 of FIG. 1.

The following description of the embodiment(s) is merely exemplary in nature and is in no way intended to limit the invention, its application, or uses.

The embodiments of the present invention provide industrial robot covers which improve the transfer efficiency of robots which employ electrostatic spray guns. In one particular application, the cover enhances the electric field of the spray gun which is being used on an automobile assembly line. Those skilled in the art, however, will appreciate that the teachings of the present invention have broader application to materials other than paint and products other than automobiles.

With general reference to the drawings and with particular reference to FIG. 1 to 4, a cover assembly 10 in accordance with the present invention may be seen. The cover 10 surrounds a robot 12. A nozzle 14 of the robot 12 extends through an opening 15 in the cover 10. From the nozzle 14 paint may be sprayed upon an object upon which a high quality painted finish is desired. An arrow indicates the direction 16 in which it is desired that the paint should travel.

As the robot applies paint to an object (not shown) the robot 12 varies the position of the nozzle 14 to optimize the spray pattern and to reach all surfaces to be painted. The cover assembly 10 fits around the arms and joints of the robot 12 with enough slack to allow the robot its full range of motion, yet not so much that the robot may become entangled in the cover. Meanwhile, contamination generated by the robot 12 remains with the cover assembly 10. Likewise, the cover assembly 10 protects the robot 12 from paint particles drifting from the nozzle 12 and back splattering from the object and environment The cover assembly 10 includes three major pieces: a main body portion 17; insulator 18; and a conductor 20. The insulator 18 is the protective shield which prevents contamination from migrating from the robot 12 and prevents paint from reaching the robot 12. Preferentially the insulator 18 may be made from 7⁄16" thick laminated foam.

Above and behind the nozzle opening 15, the conductor 20 may be seen in FIGS. 1 to 4. To supply the charge, a cable connects the conductor 20 to a D.C. source (not shown). The charge supplied to the conductor 20 should be the same polarity of that supplied to the paint and opposite to that supplied to the object to be painted. While the voltage of the conductor 20 and the paint may be the same, it need not be the same. To avoid entanglement with the robot 12, the cable should be routed on the outside of the cover assembly 10 and then to a take up reel, or tension control device, at the earliest practical opportunity.

The robot 12 itself is grounded and thus neutral. Since the robot 12 is grounded, an insulator must be placed between the conductor 20 and the robot. For this reason a main body 17 of the cover assembly 10, or the insulator 18, must be made of nonconductive material. Otherwise the charge on the conductor 20 would drain off creating an unnecessary power draw and otherwise wasting the advantages of the present invention.

Figure 5:
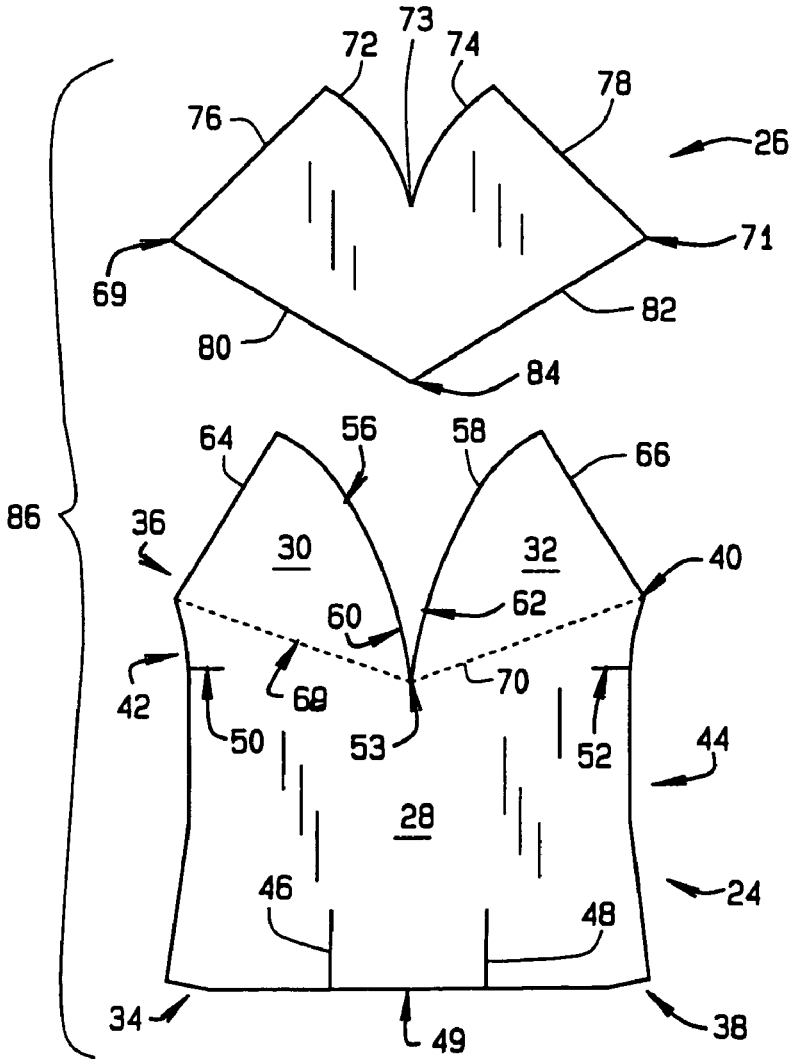
FIG. 5 is an exploded view of another cover in accordance with the present invention.

Turning now to FIG. 5, a cover 86 for a painting robot in accordance with the present invention may be seen. An exemplary insulator 24 and an exemplary conductor 26 for the cover 86 may be seen in relation to one another before they are sewn together. Insulator 24 includes a body 28 and two flaps 30 and 32. Four slight projections 34, 36, 38, and 40 extend from the corners of the generally rectangular body 28. Because of the projections 34-40, the body 28 has two shallow convex arcs 42 and 44 subtending generally opposite sides of the body.

On the body 28, a pair of raw slits 46 and 48 extend into the body 28 from a back edge 49. Another pair of raw slits 50 and 52 extend from the convex arcs 32 and 34 into the body 26. A point 53 (to be discussed further herein) lies at about the same distance from the back edge 49 as do the raw slits 50 and 52. Raw slits 46, 48, 50, and 52 facilitate subsequent folding of the insulator 24 in subsequent assembly steps. Another raw slit 54 lies near, and roughly perpendicular to the raw slit 52 to facilitate access and maintenance to the robot 12. Note that all of the slits in the insulator 24 may be raw as opposed to be selvage or hemmed.

The two flaps 30 and 32 define the front portion of the insulator 24. The pie piece shaped flaps 30 and 32 have an apex coincident with the projections 36 and 40. The pie shaped flaps 30 and 32 sweep through two roughly arc shaped edges 56 and 58 respectively of approximately 90 degrees. Note that the arc shaped edges 56 and 58 include roughly linear sections 60 and 62. Two front edges 64 and 66 complete one side of the pie shaped flaps 30 and 32. With the other side of the flaps 30 and 32 merging into the body 28 along lines 68 and 70. While the flaps 30 and 32 and body 28 have been described separately the insulator 24 is typically cut whole from sheets of foam. The lines 68 and 70 angle toward the back of the body 28 and meet at the point 53.

Conductor 26 generally reflects the shape and dimensions of the pair of flaps 30 and 32 taken together. The conductor 26 includes apexes 69 and 71, two arc shaped edges 72 and 74 sweeping through something less than about 90 degrees and meeting at a point 73, two front edges 76 and 78, and two back edges 80 and 82 meeting at point 84.

To fabricate the cover 86 shown in FIG. 5, the insulator 24 and the conductor 26 are fabricated to the desired shapes. Then, by folding the conductor along a line between the points 73 and 84, the arc shaped edges 72 and 74 may be straight stitched together. The seam between arc shaped edges 72 and 74 will form the straight stitch 87 (see FIG. 6) near a line defining the highest portion of the insulator 26 when assembled into the cover 86. Similarly, the arc shaped edges 56 and 58 and the linear edge portions 60 and 62 are straight stitched together by folding the insulator 24 along a line between the point 53 and the midpoint of the back edge 49.

Preferably, these two stitches are accomplished on the side of the insulator 24 and conductor 26 folded in (as opposed to the side exposed after the folding of the respective pieces). Thus, the two inside seams of the cover 86 will have been stitched together in step 118.

When the conductor 26 is placed on top of the insulator 24 to continue assembling the cover 86, the following parts of the conductor 26 generally aligned with the following parts of the insulator 24:

Edges 80 and 82 generally align with lines 68 and 70.

The apexes 69 and 71 generally align with apexes 36 and 40.

The point 84 generally aligns with the point 53. Though the point 73 generally lies to the front of the point 53.

The edges 76 and 78 generally align with edges 64 and 66 except that the edges 76 and 78 preferably extend about 1" beyond edges 64 and 66.

Arc shaped edges 72 and 74 align with arc shaped edges 56 and 58 up to the point 73 where the edges 72 and 74 meet and the linear sections 60 and 62 begin.

Along the extension of the front edges 76 and 78, the conductor is folded around the front edges 64 and 66 of the insulator 24. By knitting the front edges 76 and 78 (of the conductor 26) to the flaps 30 and 32 along the front edges 64 and 66 (of the insulator 24), a conductor lined aperture 92 (see FIG. 6) will have been formed. Next, the conductor 26 is top stitched to the insulator 24 along edges 80 and 82 of the conductor 26 and the lines 68 and 70 of the insulator 26. A set of snaps 95 along the unstitched edges may be added as well as a charge cord 99. Note that snaps 95, which are preferably white nylon, should only be put on the insulator 26 to protect the integrity of the conductor 26.

In embodiments of the present invention, the conductor may be placed on specific areas of the cover. For instance, the conductor can be a band of conductive material on the inside surface of the cover near the front edge of the cover (i.e. the band conductor lines the surface at the aperture). In the alternative, the band conductor can be placed on the outside surface of the aperture near the front edge of the cover. Another alternative includes a ring shaped conductor placed on the front edge of the cover where the cover terminates at the aperture. In another embodiment, a layer of foam may be used to cover the various conductors described herein. In the latter embodiment, personnel will be protected from the charged conductor. Alternatively, the conductor may be placed on the front, top surface of the cover, as shown in FIG. 6, to repel paint droplets which tend to aggregate in the air above that area.

Figure 6:
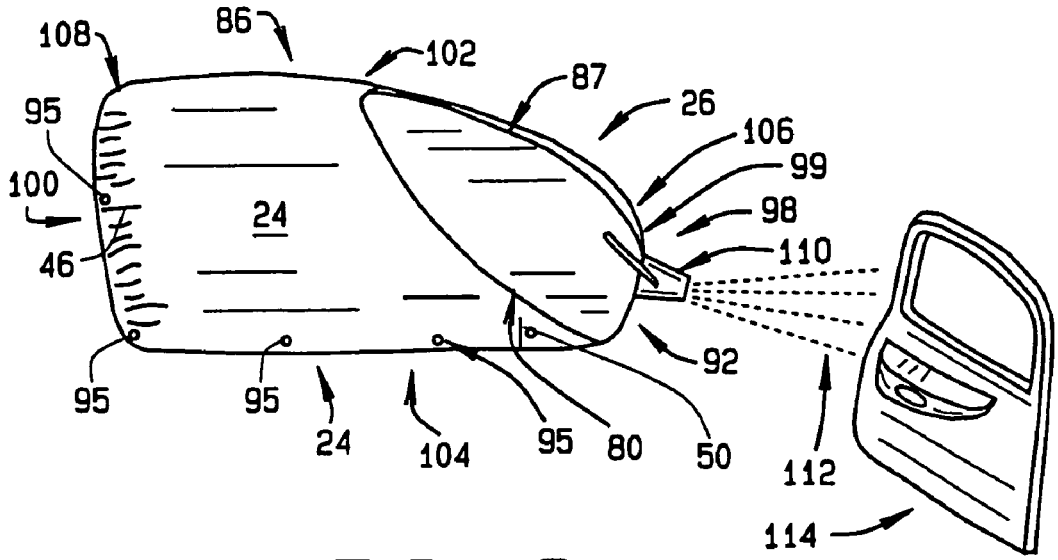
FIG. 6 is an assembly view of the cover of FIG. 5.

Generally, without regard to the ordering of the steps in the method 88 (FIG. 7), the cover 86 will have been fabricated as shown in FIG. 6. A front side 98 including the conductor lined aperture 92; a back side 100, a top 102, and a bottom side 104 generally define the cover 86. A robot, or robot forearm, may reside in the cover 86 with an electrostatic spray nozzle 110 extending from the aperture 92. Gathering 106 at the front side 98, around aperture 92, is limited due to the geometry of the parts. Gathering 108 along the back side 100 may be controlled as aesthetics and avoidance of entanglement with the robot may make desirable.

After fabrication, the cover 86 should be laundered, inspected, and packaged. Such post fabrication processing should be performed in an atmosphere filtered with an efficiency of greater than 99.99% for particles exceeding 0.3 microns. Additionally, appropriate clean room procedures should be maintained to limit particulate contamination of the cover 86.

In operation, a paint stream 112 spraying from a nozzle 110 is charged with a voltage of one polarity. The paint tends to move along the central axis (not shown) of the nozzle. An object 114 to be painted is charged with the opposite polarity. As the paint exits the nozzle 110, the charge of the conductor 26 repels the charge on the paint 112. Accordingly the paint 112 is not only drawn by the charge on the object 114, but the paint 112 is also pushed toward the object 114 by the charge on the conductor 26.

While not wishing to be held to the following theory, it is believed that the present invention operates as follows. Since the conductor lined aperture 92 roughly resembles a circular electrostatic lens, the aperture 92 tends to focus the charged paint 112 to a more precise spray pattern. In particular, the circular area of the charged conductor 26 near the aperture 92 generates a net electrostatic force on each paint particle 112. The force includes a horizontal component which drives the paint particles 112 toward the object 114 faster than they would otherwise travel. Accordingly, the travel time of the paint particles 12 is reduced during which undesired influences may cause the particles to drift.

Importantly, a paint particle 112 deviating from the central axis of the nozzle 110 moves closer to one side of the circular area than another side of the circular area (while continuing to travel away from the conductor 26 as a whole). Accordingly the force arising from the closer side increases while the force from the farther side decreases. The net force from these two sides directs the paint particle back to the central axis. For instance a paint particle 112 drifting up from the center axis moves closer (in the vertical) to the upper side of the aperture and farther from the lower side of the aperture. Thus a net force from the conductor 26 directs the paint particle 112 down and back to the central axis. Thus, the conductor 26 near the aperture 92 focuses the spray pattern of the nozzle 110. Because of the foregoing effect the efficiency of the electrostatic spray gun rises.

In FIG. 6, it will be noted that the conductor is located generally along the top 102 and front 98 sides of the cover 86. In that position, the cover 86 advantageously protects the robot from paint back splattering from the working area and from paint drops agglomerating in the air above the robot and dropping therefrom. Moreover, the electromagnetic field emanating from the cover 26 tends to repel the charged paint particles which would otherwise deposit or back splatter onto the cover 26. Additionally, the focused electromagnetic field emanating from the conductor lined aperture 92 tends to repel back spattered paint, thereby preventing the interior of the cover 86 from being contaminated with paint.

Figure 7:
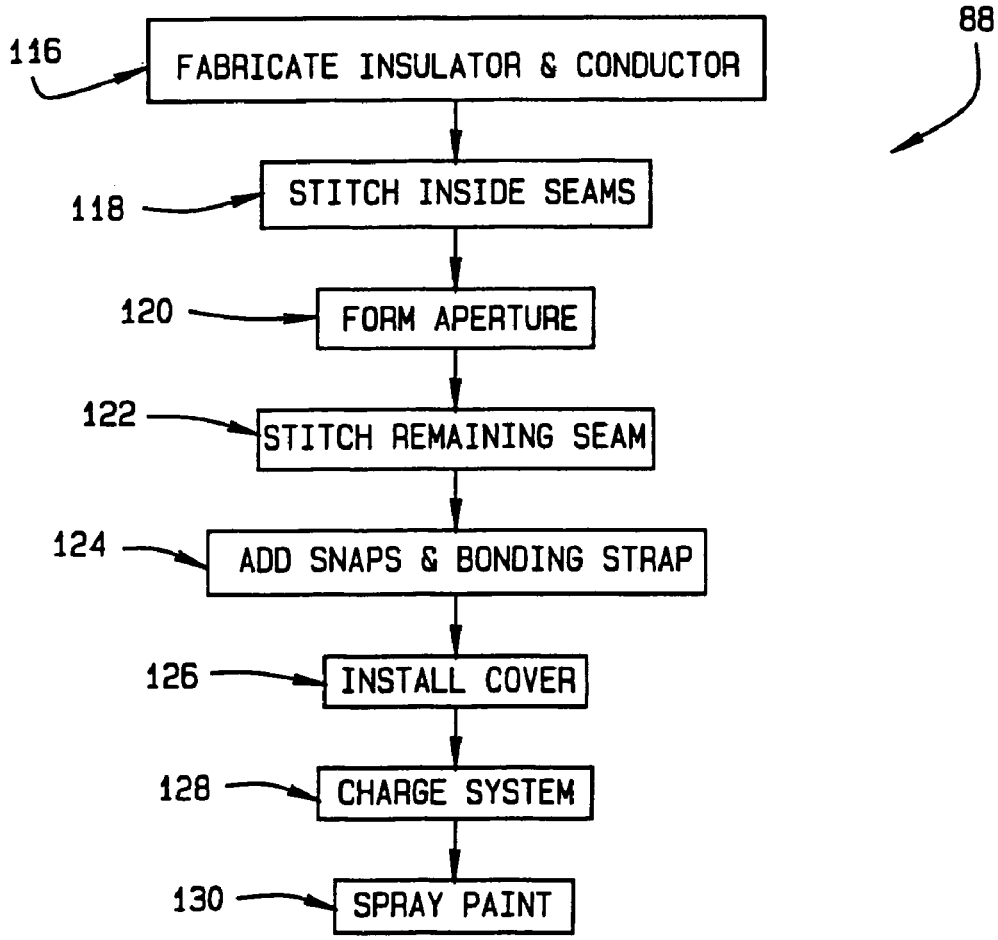
FIG. 7 is a flowchart of a method in accordance with the present invention.

Referring now to FIG. 7, a flow chart of a method 88 in accordance with an embodiment of the present invention may be seen. In a step 116, the method begins with the fabrication of an insulator and conductor. The geometry of the insulator and conductor may generally be selected so that the resulting cover will cover a particular model of robot. Though the spirit and scope of the present invention includes covers of general applicability. Additionally, the placement of the conductor in relation to the nozzle of the spray gun may be determined empirically with adjustments made until the spray pattern is optimized.

After fabricating the insulator and conductor, these two components are shaped and sewn together. For instance, step 118 shows the inside stitches between the edges of the insulator and the conductor being sewn together. The conductor lined aperture may be formed at this time as in step 120. Any remaining stitches, for example the outside stitching in a step 122, may then complete the assembly of the conductor and the insulator. Snaps and the power cord may then be added to the assembly in steps 124 and 126. Of course, the snaps should only be added to the insulator rather than the conductor.

The completed cover may then be draped around a robot and connected to a D.C. power source to charge the conductor. Once the cover is in place, the paint and the conductor may be charged while the object to be painted is charged with the opposite charge in step 128. Using the enhancement to the electric field of the spray gun provided by the present invention, in step 130, the robot paints the charged object. It will be recognized that the robot may be used to paint more than one object. For instance, the robot could be employed on an assembly line with a stream of charged objects passing by it. In the alternative, the robot could be located in a paint booth with objects being brought to it and charged prior to being painted.

The assembly line could be for automobiles, aircraft, boats, consumer appliances, or any object requiring a high quality, blemish free, painted surface. Moreover, the material the robot sprays need not be paint. For instance, various primers, stains, shellacs, varnishes, lacquers, corrosion resistant coatings, bonding agents, coatings, powders, polishes, or waxes could be advantageously sprayed on the object.

Regardless of the object and material, less overspray and back splattering will occur. Thus fewer covers may be used to protect the robot thereby allowing a greater range of robot motion and easier access for maintenance. With these advantages, a reduction in maintenance and cleaning costs of the robot accrue to the owner of the robot and the cover of the present invention. Importantly, with reduced cleanup comes the reduced requirement for clean up solvents. Thus, the present invention also reduces pollution and enhances the environment.

An electrostatic spray gun with improved efficiency has been described. More particularly, an improved cover for an electrostatic paint spray gun on a painting robot has been described. Since the efficiency of the electrostatic spray gun has been improved, the power consumption of the device decreases quite advantageously. Likewise, since the spray pattern has been better controlled, less paint may be used to cover even difficult to paint objects with less over spray.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cover for a robot, the robot including an electrostatic spray gun including a nozzle to spray an electrically charged material on to an object, the cover comprising:

an insulator at least partially surrounding the robot during use of the cover, the insulator including an aperture to allow the nozzle of the spray gun to extend from the cover;

a conductor in the form of a chargeable conductive layer in contact with the insulator over a surface area of the insulator near the aperture; and a charge source coupled to the conductor to electrically charge the conductor.

2. The cover according to claim 1, wherein the conductor contacts a forward inside surface of the insulator.

3. The cover according to claim 1, wherein the conductor contacts a front, top surface of the insulator.

4. The cover according to claim 1, the insulator further comprising a laminated foam.

5. The cover according to claim 1, the conductor further comprising a metallic mesh.

6. The cover according to claim 1, the conductor further comprising a band.

7. The cover according to claim 1, the conductor further comprising a ring.

8. A method of painting using the cover for a robot of claim 1, the robot including an electrostatic spray gun including a nozzle to spray an electrically charged paint material on to an object, the method comprising:

covering the robot with the insulator of the cover, such that the nozzle extends from the aperture of the insulator;

charging the conductor of the cover with the same polarity charge as the paint material spraying from the spray gun; and spraying the object with the paint material.

9. The method according to claim 8, further comprising placing the conductor in area contact with a forward, inside surface of the insulator around the aperture.

10. The method according to claim 8, further comprising placing the conductor in area contact over a front, top surface of the cover.

11. The method according to claim 10, further comprising placing the insulator of the cover between the conductor and the spray gun.

12. The method of claim 8, further comprising charging the object with an electric charge opposite that of the charge on the material, and positioning the object to be sprayed with the material.

13. The method of claim 8, wherein the object further comprises a car.

14. A cover for a robot in combination with a robot, the combination comprising:

a robot including an electrostatic spray gun including a nozzle to spray an electrically charged material on to an object; and a cover for the robot, the cover comprising:

an insulator at least partially surrounding the robot, the insulator including an aperture, the nozzle of the spray gun extending from the aperture;

a conductor in the form of a chargeable conductive layer spaced apart from the robot and in contact with a surface area of the insulator near the aperture; and an electric charge source coupled to the conductor to charge the conductor with a charge opposite to the charge of the material to be sprayed.

15. The combination of claim 14, wherein the material further comprises paint.

16. The combination of claim 14, wherein the insulator further comprises a laminated foam.

17. The combination of claim 14, wherein the conductor further comprises a wire mesh.

18. The combination of 14, wherein the conductor further comprises a band.

19. The combination of 14, wherein the conductor further comprises a ring.

20. The combination of claim 14, wherein the conductor coupled to a forward inside surface of the cover.

21. A cover for a robot in combination with a robot, the combination comprising:

a robot including an electrostatic spray gun including a nozzle to spray an electrically charged material on to an object; and a cover for the robot, the cover comprising:

an insulator at least partially surrounding the robot, the insulator including an aperture, the nozzle of the spray gun extending from the aperture;

a conductor in the form of a chargeable conductive layer spaced apart from the robot and in contact with a surface area of the insulator near the aperture, wherein the conductor is coupled to a front, top surface of the insulator; and an electric charge source coupled to the conductor to charge the conductor with a charge opposite to the charge of the material to be sprayed.

* * * * *